US005371964A

United States Patent [19]

Kubacki et al.

[11] Patent Number: 5,371,964

[45] Date of Patent: Dec. 13, 1994

[54] DISPLAY SIGN WITH COLLAPSIBLE SUPPORT BASE

[75] Inventors: Ronald R. Kubacki, Oak Forest; Leonard J. Kubacki, Lemont, both of Ill.

[73] Assignee: K-Display Corp., Chicago, Ill.

[21] Appl. No.: 973,773

[22] Filed: Nov. 9, 1992

[51] Int. Cl.[5] ..... G09F 15/00

[52] U.S. Cl. ..... 40/610; 16/234; 16/366; 248/166

[58] Field of Search ..... 40/606, 610, 612, 152.1; 248/166, 167, 168, 173, 188.6; 16/234, 366, 346, 368, 369

[56] References Cited

U.S. PATENT DOCUMENTS 134,617 1/1873 Thompson ..... 16/234
1,881,755 10/1932 Logan et al. ..... 16/366 X
2,504,556 4/1950 Luitjens et al. ..... 40/606 X
3,056,377 10/1962 Nelson ..... 40/610 X

*Primary Examiner*—Clifford D. Crowder
*Assistant Examiner*—Paul C. Lewis
*Attorney, Agent, or Firm*—James W. Clement

[57] ABSTRACT

A display sign with a collapsible support base. The sign is supported by at least one upwardly extending leaf of a hinge element to which a pair of support legs are attached extending both in front of and behind the sign. When the support legs are extended outwardly and the base is supported on a weight-bearing surface, the legs at each end portion of the sign pivot about the hinge element to exert a pincer-like grip on the bottom portion of the display sign. When the sign is lifted up, the support legs fold down automatically into a compact form suitable for transport or storage.

22 Claims, 2 Drawing Sheets

Fig. 1
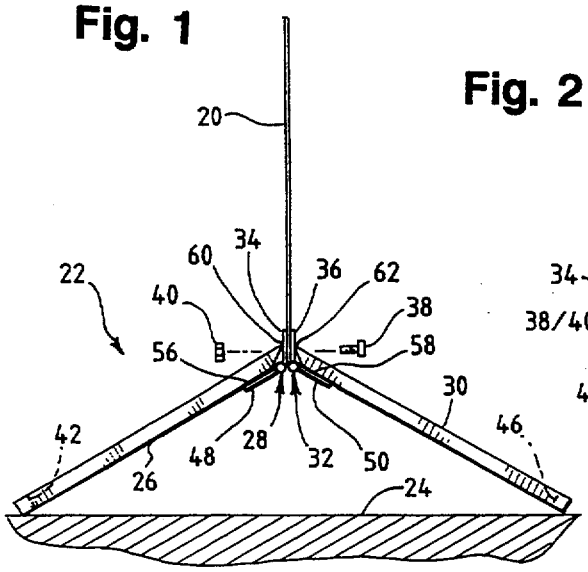
Fig. 2
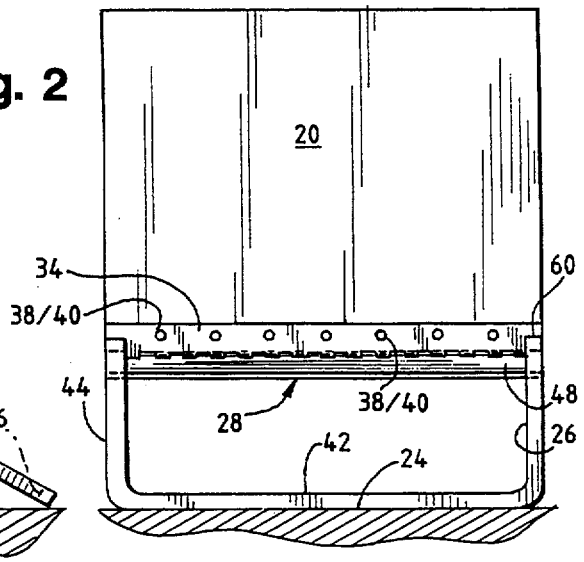
Fig. 1A
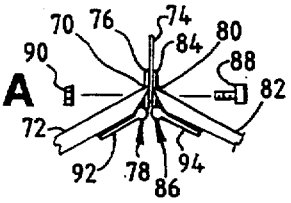
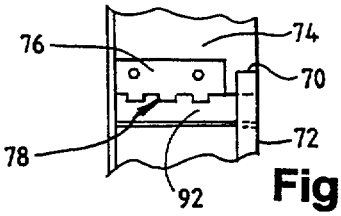
Fig. 2A
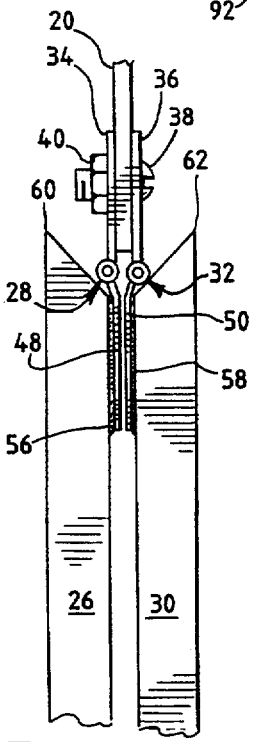
Fig. 3
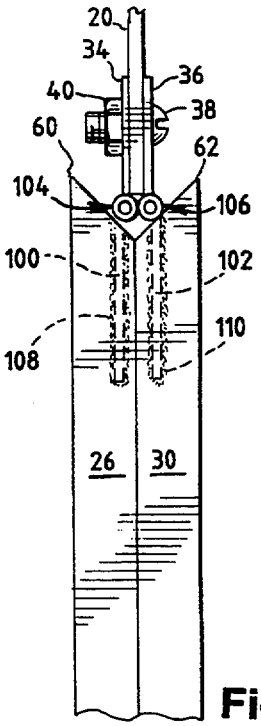
Fig. 4
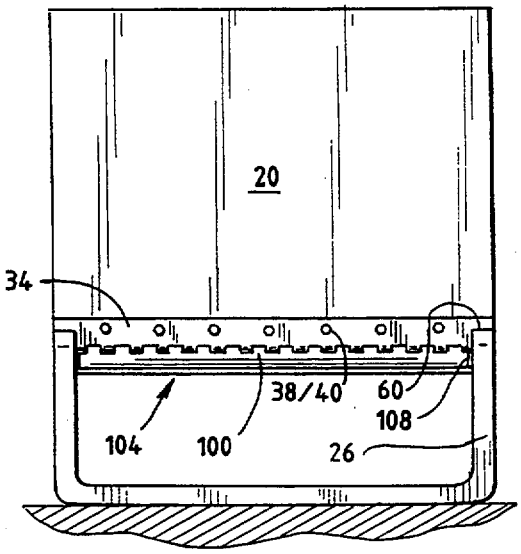
Fig. 5

Fig. 6
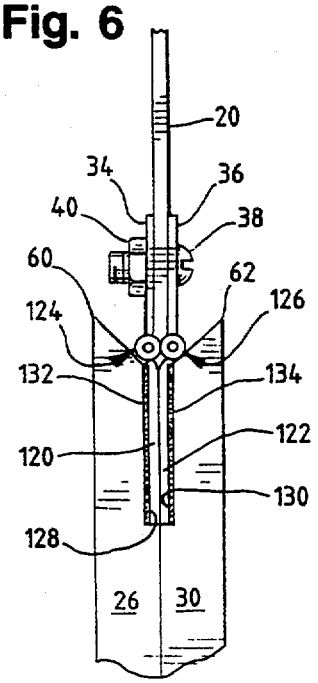
Fig. 7
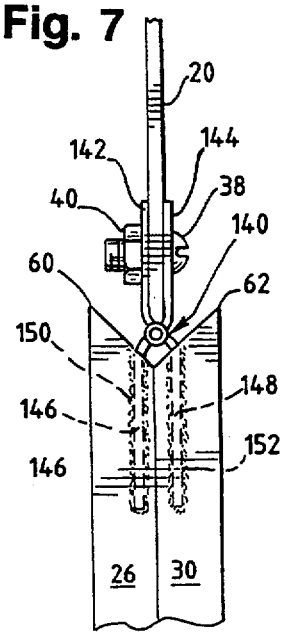
Fig. 9
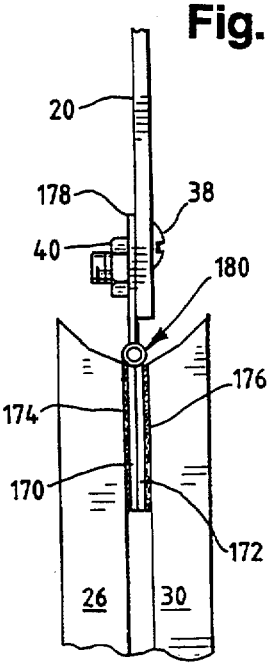
Fig. 8
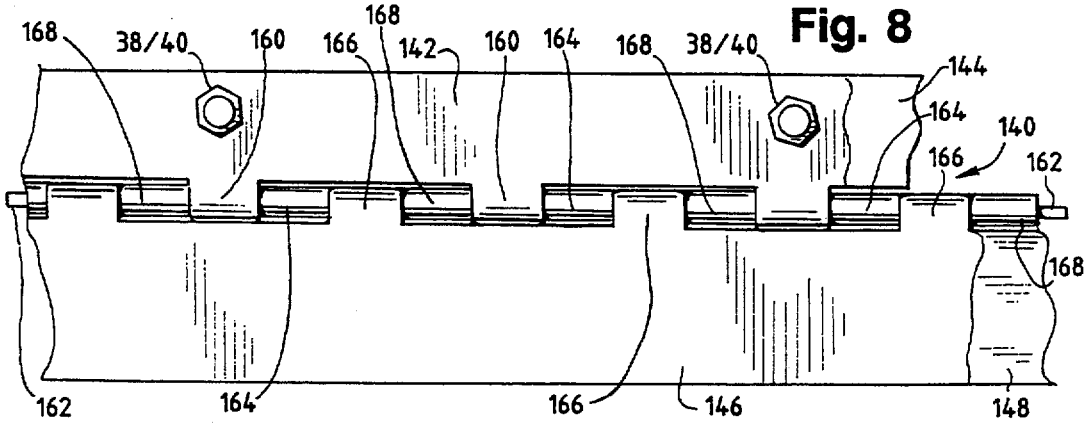
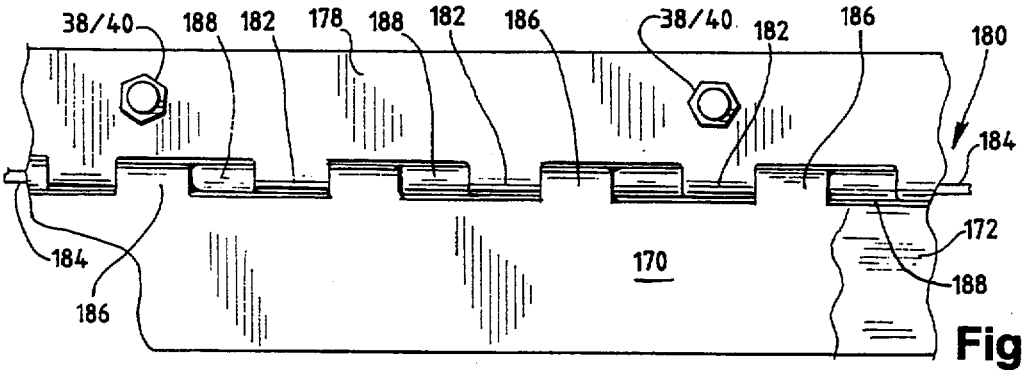
Fig. 10

DISPLAY SIGN WITH COLLAPSIBLE SUPPORT BASE

FIELD OF INVENTION

This invention relates to a display sign with a hinged collapsible support base.

BACKGROUND OF THE INVENTION

Many display signs make no attempt at all to have any kind of flexibility in the mounting of the base, and simply use fixed triangular supports at each outer end of the sign. When some flexibility in the mounting is sought, display signs of this general type are frequently mounted on two large diameter coiled springs secured to a flat bottom member.

A variety of other structures for supporting something such as a display sign have been used over the years. Five prior art patents known to applicant provide means for locking angularly disposed support legs in their open positions, and the last three of these five patents include means for locking the support legs in their closed positions as well. These five U.S. patents are U.S. Pat. No. 2,864,191 issued to Hagen Dec. 16, 1958; U.S. Pat. No. 3,527,434 issued to Mauro Sep. 8, 1970; U.S. Pat. No. 5,028,031 issued to Stoudt Jul. 2, 1991; U.S. Pat. No. 5,040,321 issued to Stoudt Aug. 20, 1991; and U.S. Pat. No. 5,079,861 issued to Stoudt Jan. 14, 1992.

Only two prior art patents are known to applicant in which triangularly disposed support legs are free to fold downward into a closed position when the device is lifted up from the support surface on which it is standing. In both these instances the support legs are kept from moving beyond their support positions by chains or folding links. These two U.S. patents are U.S. Pat. No. 2,900,158 issued to Ditter Aug. 18, 1959 and U.S. Pat. No. 3,219,300 issued to Gunderson Nov. 23, 1965.

U.S. Pat. No. 2,844,897 issued to Vance Jul. 29, 1958 discloses a complicated structure in which the pivot point about which the outwardly extendable legs pivot is slidably enclosable in a boxlike member for transportation of the display sign.

None of these prior art references, which were issued over a long period of time, provides the combination of advantages that is achieved by applicant's invention.

SUMMARY OF THE INVENTION

The vertically disposed, sheet-like display sign of this invention has a collapsible support base that includes hinge means with at least one upwardly extending hinge leaf which supports the display sign, and first and second downwardly extending hinge leaves pivotally secured to the at least one upwardly extending leaf. The opposite outer surfaces of the hinge means are rigidly positioned with respect to each other at least when the support base is in its operative, weight-bearing, upright position.

The hinge means has at least one pivot point, and may have two. Each of these pivot points is fixed in position at all times with respect to the display sign.

The upper end of the support leg that is secured to the first downwardly extending hinge leaf of the hinge means is adapted to exert an opposing force against the upper end of the support leg that is secured to the second downwardly extending hinge leaf when the support legs are pivoted outward to form an inverted "Y" and the legs are supported on a weight-bearing surface. This opposing force is exerted through the upwardly extending hinge leaf or leaves and the portions of the display sign that are in contact with the leaf or leaves, or may if desired be exerted only through the display sign itself. (In the latter case the upper leaf or leaves must be shorter in lateral extent than the display sign itself.)

An equal and opposite force is exerted in the same way, against the upper end of the support leg that is secured to the first downwardly extending hinge leaf, by the upper end of the support leg that is secured to the second downwardly extending hinge leaf of the hinge means. The opposing forces exerted by the upper ends of the two support legs produce a secure, reliable pincer-like grip on the bottom portion of the display sign.

Whenever a support leg is free of contact with the weight-bearing surface on which the support base of the display sign is supported during use, each of the support legs is free to pivot about the pivot point of its associated hinge means. The support legs can then pivot toward each other to form a flat, fully collapsed piece of equipment. In one embodiment of the invention, when the support legs are folded together in their fully collapsed condition, the lower ends of the legs are in contact with each other and the upper ends are separated by a distance no greater than the combined thickness of the first and second downwardly extending hinge leaves. In a preferred embodiment, in the fully collapsed condition of the display sign the support legs are in contact with each other along their entire lengths.

The support base for use in the display sign of this invention is also disclosed and claimed as a subcombination of the apparatus.

ADVANTAGES OF THE INVENTION

The described structure of the display sign support base of this invention provides a combination of three important advantages that is not provided by any previously known sign support bases:

1. A rigid support base is provided for the display sign when it is in its erect, display position.

2. The support base collapses of its own weight if the sign is accidentally knocked over. Display signs of this general type are frequently located on the premises of a gasoline service station, where an automobile may happen to strike the sign accidentally. If the display sign of this invention is bumped into it can be tilted very far over and still, because the pivot point of the hinge element for the support base is fixed in position with respect to the display sign, the pincer-like grip of the upper ends of the support legs on the bottom part of the sign (either through the at least one upwardly extending hinge leaf or directly against the sign) will be automatically and securely re-established when the sign and its base settle back into their operative positions.

3. At the same time, if the sign is tipped over completely, it will tend to rise up and its legs will automatically fold flat, with ordinarily no damage occurring to the sign or to its support base.

4. If the sign and its attached base are lifted up by the person using this sign, the support legs will close automatically to form a flat piece that is convenient for transport and storage.

BRIEF DESCRIPTION OF THE DRAWINGS

The invention will now be described in more detail with reference to the accompanying drawings, in which:

FIG. 1 is an end view of one embodiment of the display sign and support base of this invention in their upright, operative position on a weight-bearing surface, with the upper ends of the support legs bearing against the upper leaves of the two hinges that make up the hinge means of the structure;

FIG. 1A is a fragmentary end view of another embodiment of this invention in which the upper ends of the support legs bear against the display sign itself;

FIG. 2 is a front view of the embodiment of FIG. 1 as seen from the left in the latter Figure;

FIG. 2A is a fragmentary end view of the embodiment of FIG. 1A as seen from the left in the latter Figure;

FIG. 3 is an enlarged, fragmentary view of the hinge means of the embodiment of FIG. 1, in which the lower leaves of the two hinges are secured to the bottom sides of the folding support legs;

FIG. 4 is a similar enlarged, fragmentary view of a hinge means in which the lower leaves of the two hinges are secured to the inner sides of the folding support legs;

FIG. 5 is a front view of a display sign and support base according to this invention that includes the hinge means shown in FIG. 4;

FIG. 6 is a fragmentary view similar to FIG. 3, with the lower leaves of the two hinges positioned and secured within grooves on the bottom sides of the associated support legs;

FIG. 7 is a fragmentary view similar to FIG. 4 in which the hinge means of the display sign and its support base has a single pivot point;

FIG. 8 is a fragmentary front view of the hinge shown in FIG. 7, as seen from the left in the latter Figure;

FIG. 9 is a fragmentary view similar to FIG. 3, but with a single pivot point and a single upper hinge leaf; and FIG. 10 is a fragmentary side view of the hinge shown in FIG. 9, as seen from the left in the latter Figure.

DESCRIPTION OF SPECIFIC EMBODIMENTS

FIG. 1 provides an end view of one embodiment of the display sign 20 and support base 22 of this invention. In this view the display sign and base are in their upright, operative position on a weight-bearing surface 24.

Support leg 26 extends outwardly and downwardly from hinge 28 on the left hand side of the Figure. Support leg 30 extends outwardly and downwardly from hinge 32 on the right hand side of the Figure. Support legs 26 and 30 form an inverted "Y"-shaped configuration with upwardly extending hinge leaves 34 and 36 of hinges 28 and 32, respectively, and with display sign 20 to which the upper leaves are secured by a plurality of bolts 38 and nuts 40.

A minimum of two bolts 38 with associated nuts 40 can be used, and with a heavy display sign 20 as many bolts and nuts may be used as necessary. With most signs, however, it has been found that three points of attachment provide sufficient support for the sign.

As best seen in FIG. 2, in this embodiment support leg 26 is connected by bight 42 to a similar support leg 44 at the opposite end of the support base, to form a generally "U"-shaped member. In the same way support leg 30 is connected by bight 46 with a corresponding support leg at the other end of the support base. Bight 42 and bight 46 may be omitted if desired, but the pair of support legs 26 and 44, as well as the similar legs on the other side of the support base, will be of considerably less structural strength.

As will be seen, the pair of support legs extending in front of the display sign and the pair of support legs extending behind the sign are identical in structure. This fact simplifies the mass production of the support base of this invention appreciably.

In this embodiment, the hinge means for support base 22 includes two hinges 28 and 32 that extend laterally from the near end portion of the support base seen in FIG. 1 to the far end portion of the support base. In other words, each of upper leaves 34 and 26 and lower leaves 48 and 50 of the two hinges 20 and 32, respectively, extends laterally for the full width of support base 22.

If desired, the hinge means of the support base can be divided into two separate hinges on each side of the display sign, and each separate hinge can be as narrow as the width of each support leg to which it is attached. The upper hinge leaves would then be secured by appropriate means to the display sign. Such an embodiment would, however, provide a support base having lower structural strength than the embodiment of FIGS. 1 through 3, since that embodiment has hinge means 28 and 32 that extend all the way from one end of the support base to the other end.

As will be seen, upper end 60 of support leg 26—which leg is secured to the bottom side (as viewed in FIG. 1) of first downwardly extending hinge leaf 48 of hinge means 28—is adapted to exert an opposing force against upper end 62 of support leg 30, which is secured to second downwardly extending hinge leaf 50, when the support legs are pivoted outward to form the inverted "Y" seen in FIG. 1 and the legs are supported on a weight-bearing surface. This opposing force is exerted through upwardly extending hinge leaf 34 and display sign 20. A similar but opposite force is exerted by upper end 62 of leg 30.

These opposing forces exerted by upper ends 60 and 62 of legs 26 and 30, respectively, produce a pincer-like grip on the bottom portion of the display sign. So long as the weight of the sign is supported on the illustrated support base, this grip will continue to be secure and reliable. Indeed, the more force that is exerted vertically in the downward direction by the display sign or by someone leaning against it, the more secure and reliable the grip exerted by legs 26 and 30 will be.

FIG. 1A is a fragmentary end view of another embodiment of the support base of this invention, in which upper end 70 of support leg 72 bears directly against display sign 74 instead of against upper leaf 76 of hinge 78. This exerts an opposing force through sign 74 itself against upper end 80 of support leg 82 instead of against upper leaf 84 of hinge 86. The display sign is again held in place between upper hinge leaves 76 and 84 by means of a plurality of bolts 88 and nuts 90.

FIG. 2A is the fragmentary front view of the embodiment of FIG. 1A as seen from the left in the latter Figure. As will be seen, in this embodiment upper leaf 76 of hinge 78 is shorter laterally than lower leaf 92 to which support leg 72 is secured, in order that upper end 70 of the support leg will bear directly against display sign 74. The same is true of upper leaf 84 of hinge 86—on the opposite side of the support base—with respect to lower leaf 94 of that hinge.

FIG. 3 is an enlarged, fragmentary view of the hinge means of the embodiment of FIG. 1, with support legs 26 and 30 folded down into positions substantially parallel to each other. As pointed out above in connection with FIG. 1, each of lower leaves 48 and 50 of hinges 28 and 32 is welded (at 56 and 58, respectively) to its associated support leg 26 and 30. Upper leaves 34 and 36 are secured to display sign 20 by plurality of bolts 38 and nuts 40.

FIGS. 4 and 5 illustrate an embodiment of a support base according to this invention that differs from the embodiment of FIGS. 1 through 3 in that lower leaves 100 and 102 of hinges 104 and 106 are welded to the inner sides (with respect to the entire apparatus) of support legs 26 and 30 at 108 and 110, respectively. As will be seen, this makes it possible for the support legs to be moved into full contact with each other, which reduces the thickness of the space occupied by the folded legs even more.

FIGS. 6, 7 and 9 are fragmentary end views of other embodiments of hinge means that may be used with the support base of this invention.

FIG. 6 is a fragmentary view similar to FIG. 3, with the exception that lower leaves 120 and 122 of hinges 124 and 126 are positioned within grooves 128 and 130 along the bottom sides of associated support legs 26 and 30, and are secured to the support legs in those positions by welding at 132 and 134, respectively. This, again, makes it possible to bring the support legs into full contact with each other when they are in their folded position.

FIGS. 7 and 9 are fragmentary end views of an embodiment of a support base according to this invention in which the hinge means has a single pivot point. In FIG. 7, single hinge 140 has two upwardly extending leaves 142 and 144 and two downwardly extending leaves 146 and 148. Legs 146 and 148 are welded, at 150 and 152, to the inner sides of support legs 26 and 30, respectively. Upper leaf 142 and lower leaf 146 on one side of hinge 140, as well as upper leaf 144 and lower leaf 148 on the opposite side of the hinge, all pivot separately around the single pivot point of the hinge.

FIG. 8 is a fragmentary view of hinge 140 of the embodiment of FIG. 7 as seen from the left in the latter Figure (with display sign 20 and support legs 26 and 30 omitted for clarity). Knuckles 160 connect upper leaf 142 of hinge 140 with pivot pin 162, about which the leaf pivots. Knuckles 164 pivotally connect opposite upper leaf 144 to pivot pin 162. Similarly, knuckles 166 pivotally connect lower hinge leaf 146 with pivot pin 162. Knuckles 168 pivotally connect lower hinge leaf 148 to the pivot pin.

FIG. 9 is a fragmentary view of hinge means in which the downwardly extending leaves 170 and 172 are welded to the bottom sides of support legs 26 and 30, through welding at 174 and 176, respectively. This embodiment includes only a single upwardly extending hinge leaf 178 for hinge 180. The display sign is attached to upper hinge leaf 178.

FIG. 10 is a fragmentary view of the hinge shown in FIG. 9, as seen from the left in the latter Figure (with display sign 20 and support legs 26 and 30 omitted for clarity). Knuckles 182 pivotally connect upper hinge leaf 178 to pivot pin 184. Knuckles 186 pivotally connect lower hinge leaf 170 to the pivot pin. Opposite lower hinge leaf 172 is connected to the pivot pin through knuckles 188.

While the present invention has been described above and illustrated in the accompanying drawing in connection with the best mode presently contemplated by the inventor for carrying out his invention, the preferred embodiments described and shown are for purposes of illustration only, and are not to be construed as constituting any limitation of the invention. Modifications will be obvious to those skilled in the art, and all modifications that do not depart from the spirit of the invention are intended to be included within the scope of the appended claims.

We claim:

1. A display sign with a collapsible support base which comprises:

(a) a vertically disposed, sheet-like display sign;

(b) hinge means, said hinge means having at least one upwardly extending leaf and first and second downwardly extending leaves pivotally secured to said at least one upwardly extending hinge leaf, said hinge means supporting the weight of the display sign when said support base is in its operative, weight-bearing, upright position, said hinge means having at least one pivot point, said at least one pivot point being fixed in position at all times with respect to said display sign;

(c) means attaching said sheet-like display sign to said at least one upwardly extending hinge leaf; and (d) a support leg secured to each of said downwardly extending leaves of said hinge means at opposite outer end portions of the hinge means, the upper end of each of said support legs that are secured to said first and second downwardly extending hinge leaves exerting an opposing force directed against the upper end of the support leg that is secured to the other of said downwardly extending hinge leaves when (i) each of said support legs is pivoted outward about its associated pivot point to form an inverted "Y" with said at least one upwardly extending hinge leaf and (ii) said legs are supported on a weight-bearing surface, each of said support legs being free to pivot about the pivot point of its associated hinge means whenever the leg is free of contact with said weight-bearing surface, whereby:

a rigid support base is provided for the display sign when the sign is in its erect, display position, the support base will collapse of its own weight if the sign is accidentally knocked over, and the legs are readily folded together by the user into a small space when it is desired to transport or store the sign and its base.

2. The display sign of claim 1 in which said hinge means comprises a first hinge and a second hinge, each of which hinges has an upwardly extending leaf and a downwardly extending leaf.

3. The display sign of claim 2 in which the upper end of each support leg that is secured to the downwardly extending hinge leaf of its associated hinge exerts an opposing force, when the support legs are in their inverted "Y" configuration and are supported on a weight-bearing surface, against (a) the upwardly extending leaf of its associated hinge, (b) said display sign and (c) the upwardly extending leaf of the other hinge, thereby exerting an opposing force against the upper end of the support leg that is secured to the downwardly extending leaf of said other hinge.

4. The display sign of claim 3 in which the downwardly extending leaf of each of said first and second hinges is secured to the bottom side of its associated support leg.

5. The display sign of claim 3 in which the downwardly extending leaf of each of said first and second hinges is secured to the inner side of its associated support leg.

6. The display sign of claim 3 in which the downwardly extending leaf of each of said first and second hinges is positioned within a groove along the bottom side of its associated support leg, and is secured to the support leg in that position.

7. The display sign of claim 3 in which the upper leaf of each of said first and second hinges is shorter laterally than the lower leaf to which a support leg is secured, and the upper end of each of said support legs bears directly against the display sign to exert an opposing force through the sign against the upper end of the support leg that is secured to the downwardly extending leaf of the other of said first and second hinges.

8. The display sign of claim 1 in which said hinge means comprises a hinge having a single pivot point, two upper leaves and two lower leaves, all said leaves being separately pivotable about said single pivot point.

9. The display sign of claim 1 in which said hinge means comprises a hinge having a single pivot point, a single upper leaf and two lower leaves, all said leaves being separately pivotable about said single pivot point.

10. The display sign of claim 1 in which when the support legs are folded together in their fully collapsed condition, (i) the lower ends of the legs are in contact with each other and (ii) the upper ends of the support legs are separated by a distance no greater than the combined thickness of said first and second downwardly extending hinge leaves.

11. The display sign of claim 10 in which the support legs are in contact with each other along their entire lengths when they are folded together in their fully collapsed condition.

12. For use in a vertically disposed, sheet-like display sign, the subcombination of a collapsible support base which comprises:

(a) hinge means, said hinge means having at least one upwardly extending leaf and first and second downwardly extending leaves pivotally secured to said at least one upwardly extending hinge leaf, said hinge means supporting the weight of the display sign when said support base is in its operative, weight-bearing, upright position and the sheet-like sign is placed in position on and attached to the support base, said hinge means having at least one pivot point, said at least one pivot point being fixed in position at all times with respect to said display sign when the sheet-like sign is placed in position on and attached to the support base;

(b) means for attaching said sheet-like display sign to said at least one upwardly extending hinge leaf when the sign is placed in position on and attached to the support base;

(c) a support leg secured to each of said downwardly extending leaves of said hinge means at opposite outer end portions of the hinge means, the upper end of each of said support legs that are secured to said first and second downwardly extending hinge leaves exerting an opposing force directed against the upper end of the support leg that is secured to the other of said downwardly extending hinge leaves when (i) each of said support legs is pivoted outward about its associated pivot point to form an inverted "Y" with said at least one upwardly extending hinge leaf and (ii) said legs are supported on a weight-bearing surface, each of said support legs being free to pivot about the pivot point of its associated hinge means whenever the leg is free of contact with said weight-bearing surface;

whereby when the display sign is in place upon the support base:

a rigid support is provided for the sign when in its erect, display position, the support base will collapse of its own weight if the sign and its base are accidentally knocked over, and the legs are readily folded together by the user into a small space when it is desired to transport or store the sign and its base.

13. The subcombination support base of claim 11 in which said hinge means comprises a first hinge and a second hinge, each of which hinges has an upwardly extending leaf and a downwardly extending leaf.

14. The subcombination support base of claim 13 in which the upper end of each support leg that is secured to the downwardly extending hinge leaf of its associated hinge exerts an opposing force, when the support legs are in their inverted "Y" configuration and are supported on a weight-bearing surface, against (a) the upwardly extending leaf of its associated hinge, (b) the display sign when the sign is supported by the support base, and (c) the upwardly extending leaf of the other hinge, thereby exerting an opposing force against the upper end of the support leg that is secured to the downwardly extending leaf of said other hinge.

15. The subcombination support base of claim 13 in which the downwardly extending leaf of each of said first and second hinges is secured to the bottom side of its associated support leg.

16. The subcombination support base of claim 13 in which the downwardly extending leaf of each of said first and second hinges is secured to the inner side of its associated support leg.

17. The subcombination support base of claim 13 in which the downwardly extending leaf of each of said first and second hinges is positioned within a groove along the bottom side of its associated support leg, and is secured to the support leg in that position.

18. The subcombination support base of claim 13 in which the upper leaf of each of said first and second hinges is shorter laterally than the lower leaf to which a support leg is secured, and the upper end of each of said support legs bears directly against the display sign to exert an opposing force through the sign against the upper end of the support leg that is secured to the downwardly extending leaf of the other of said first and second hinges.

19. The subcombination support base of claim 11 in which said hinge means comprises a hinge having a single pivot point, two upper leaves and two lower leaves, all said leaves being separately pivotable about said single pivot point.

20. The subcombination support base of claim 11 in which said hinge means comprises a hinge having a single pivot point, a single upper leaf and two lower leaves, all said leaves being separately pivotable about said single pivot point.

21. The subcombination support base of claim 12 in which when the support legs are folded together in their fully collapsed condition, (i) the lower ends of the legs are in contact with each other and (ii) the upper ends of the support legs are separated by a distance no greater than the combined thickness of said first and second downwardly extending hinge leaves.

22. The subcombination support base of claim 21 in which the support legs are in contact with each other along their entire lengths when they are folded together in their fully collapsed condition.

* * * * *